US005853334A

United States Patent [19]

Winebrenner

[11] Patent Number: 5,853,334

[45] Date of Patent: Dec. 29, 1998

[54] PRACTICE DRIVING DEVICE FOR GOLFERS

[76] Inventor: Thomas E. Winebrenner, 6580 E. McGuire Rd., Churubusco, Ind. 46723

[21] Appl. No.: 857,763

[22] Filed: May 15, 1997

[51] Int. Cl.[6] ..... A63B 69/36

[52] U.S. Cl. ..... 473/142; 242/390.8; 242/397; 242/370; 242/388.6; 242/399; 242/401; 473/423; 473/431

[58] Field of Search ..... 473/138, 142, 473/147, 148, 423, 431; 242/370, 388.6, 390.8, 397, 399, 401

[56] References Cited

U.S. PATENT DOCUMENTS

| | | | |
|---|---|---|---|
| 1,566,775 | 12/1925 | Schenk | 473/142 |
| 2,714,009 | 7/1955 | Noland . | |
| 3,051,491 | 8/1962 | Cabot | 473/147 |
| 3,191,880 | 6/1965 | Visconti . | |
| 3,707,268 | 12/1972 | Kelly . | |
| 3,826,439 | 7/1974 | Moon . | |
| 3,876,162 | 4/1975 | Chun et al. . | |
| 4,125,230 | 11/1978 | Fischer . | |
| 4,129,110 | 12/1978 | Kubrak . | |
| 4,240,592 | 12/1980 | Russo . | |
| 4,278,257 | 7/1981 | Garcia et al. . | |
| 4,526,374 | 7/1985 | Ban . | |
| 4,573,687 | 3/1986 | Nilsson . | |
| 4,706,964 | 11/1987 | Genovese . | |
| 4,915,388 | 4/1990 | Serin . | |
| 4,927,154 | 5/1990 | Boyer et al. . | |
| 5,431,404 | 7/1995 | Kotecki et al. . | |
| 5,662,527 | 9/1997 | Jacquinot | 473/138 |

*Primary Examiner*—George J. Marlo
*Attorney, Agent, or Firm*—Barnes & Thornburg

[57] ABSTRACT

A golf practice apparatus which comprises:

a base;

an elongated support arm coupled to the base and having a free end;

a tether guide including an eyelet coupled to the elongated support arm adjacent the free end; and a reel attached to the elongated support arm near the base and remote from the free end, the reel including a spool, the spool having a central axis which is aligned with a center of the eyelet.

15 Claims, 4 Drawing Sheets

PRACTICE DRIVING DEVICE FOR GOLFERS

TECHNICAL FIELD

The present invention relates to golf practice apparatus and more particularly to a practice driving device for golf balls which automatically retrieve a golf ball after a practice shot.

BACKGROUND ART

Those who play golf and wish to improve their game or wish to maintain their level of proficiency, often practice various aspects of golf, such as driving, putting, chipping, etc. In order to practice driving, golfers must go to driving ranges. Otherwise, if adequate space is available, a golfer can practice driving by hitting practice shots in a field, across a lawn, or across or into some other unobstructed area. The problem with practicing driving at areas other than driving ranges is that after practicing his or her driving, the golfer must find and recover hit golf balls. This ball retrieval can take a considerable amount of time.

There are currently a number of devices which either limit the distance that a golf ball travels after being hit or which automatically retrieve hit golf balls. For example, U.S. Pat. Nos. 4,927,154 to Boyer et al., 4,915,388 to Serin, 4,573,687 to Nilsson, and 4,125,230 to Fischer each disclose devices which limit the distance that a golf ball can travel after being hit.

U.S. Pat. Nos. 5,431,404 to Kotecki, 4,733,868 to Seiden, 4,526,374 to Ban, 4,240,592 to Russo, 3,876,162 to Chun et al., 3,826,439 to Moon, 3,707,268 to Kelly, 3,191,880 to Visconti, and 2,714,009 to Noland each disclose devices which can be used to retrieve tethered golf balls.

There are several obvious disadvantages with the prior art devices. For example, all of the prior art devices adversely effect the natural trajectory of a golf ball and otherwise limit the distance at which a tethered golf ball can be driven when hit.

The present invention is directed to practice driving devices for golf balls which automatically retrieve a golf ball after a practice shot.

DISCLOSURE OF THE INVENTION

The present invention provides an apparatus for practicing golf which allows a tethered golf ball to experience the flight characteristics of a non-tethered golf ball.

The apparatus of the present invention includes a reel for holding, releasing and winding a tether attached to a golf ball, and a support structure which aligns the reel and a guide for the tether at an angle which corresponds to the initial trajectory of a driven golf ball.

The reel is coupled to a mechanical drive means which effects automatic retrieval of a driven golf ball.

The present invention further provides an apparatus which allows two tethered golf balls to be driven and retrieved alternatively.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to practice driving devices for golf balls which automatically retrieve a golf ball after a practice shot. The devices include one or more tethered golf balls, an equal number of reels, guide means, and a frame assembly. The tethered golf balls comprise an anchoring member which is fixed within a golf ball, and an eyelet which is coupled to the anchoring member. A tether is attached to the eyelet. The eyelet can be coupled to the anchoring member through a swivel if desired to prevent the tether from becoming twisted. The tether can be a line, cord, string, wire, etc. which has a suitable tensile strength to withstand the impact force applied to a golf ball as it is struck by a golf club. Commercial fishing line having a two pound-test rating or greater has been found to be particularly useful for purposes of the present invention.

The reels hold, feed-out and reel-in the tether. In this regard, the reels include spools upon which the tether can be wound, stored and released. The tether can be freely pulled off the reels by the force of a golf ball during its trajectory. Thereafter, a mechanical means such as a crank or a motor can be activated and used to drive the reel so that the tether is wound back on the reel.

The guide means includes one or more eyelets which are spaced apart from and aligned with the reel(s) in such a manner as to allow the tether to be freely pulled off the reel(s) during trajectory of a tethered golf ball. The position and alignment of the guide means allows the tether to be freely pulled off the reel(s) with minimum affect on the natural trajectory of the tethered golf ball. That is, the flight characteristics of a tethered golf ball according to the present invention are substantially similar to the flight characteristics of an non-tethered golf ball.

The frame assembly includes a base which supports the device and a support arm which extends from the base and supports the reel(s) and guide means.

Figure 1A:
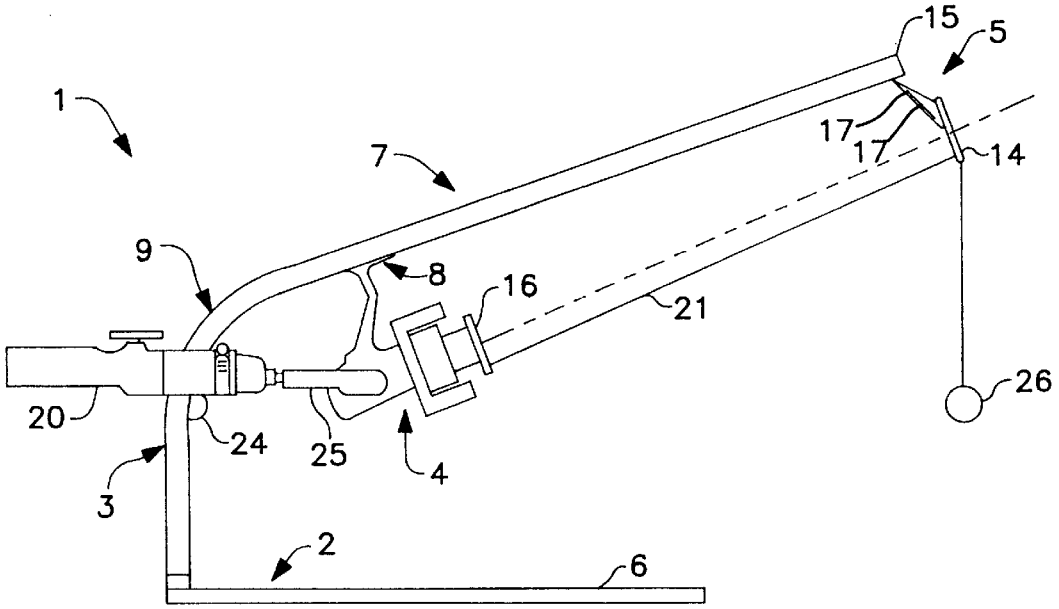
FIG. 1*a* is a side plan view of a practice driving device for golf balls according to one embodiment of the present invention.
Figure 2:
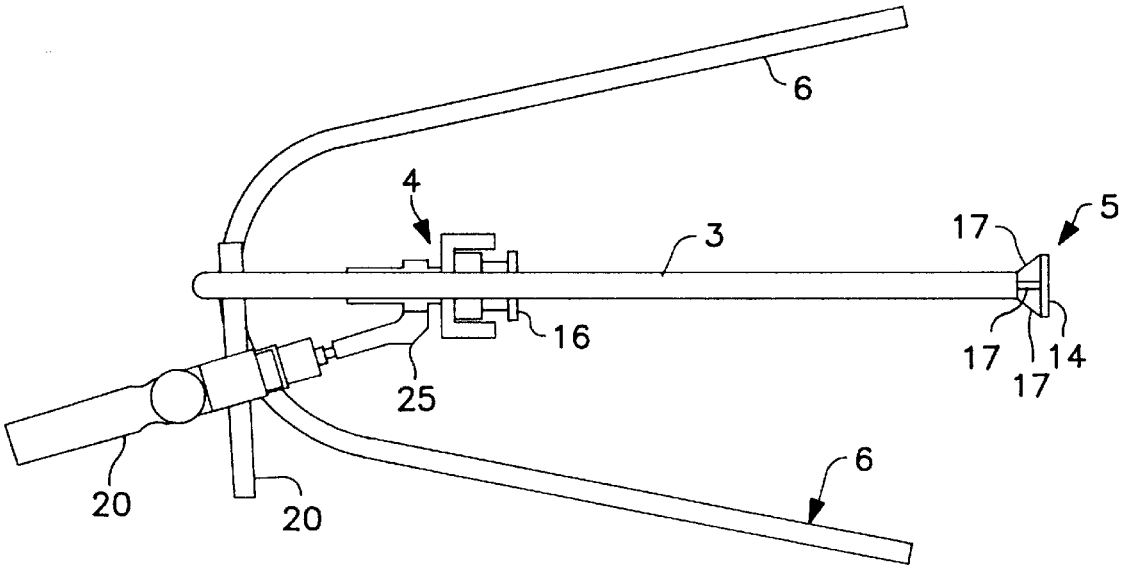
FIG. 2 is a top plan view of the practice driving device of FIG. 1*a*.

FIG. 1*a* is a side plan view of a practice driving device for golf balls according to one embodiment of the present invention. The driving device 1 of the present invention includes a base 2, a support arm 3 which extends from the base 2 as shown, a reel 4 and guide means 5. The base 2 as depicted in FIG. 2 includes two legs 6 which stabilize and support the support arm 2 and the elements attached thereto. According to one embodiment, the base 2 comprises a U-shaped member. Such a U-shaped member can be made by bending an elongated piece of metal, such as a tube, shaft, rod, bar, etc. Alternatively, the base 2 can be cast as an integral structure or assembled from a plurality of straight or curved portions which can be coupled by various connectors or by welding, brazing, soldering, etc. Rather than have a U-shape as depicted in FIG. 2, the base 2 can have a more rectangular shape, i.e. square corners or can have a V-shape. Moreover, the base 2 can have one or more cross pieces extending between legs 6. Although the legs 6 of the base 2 extend outwardly as depicted in FIG. 2, the legs 6 may be aligned parallel to one another at least at their free ends.

The support arm 3 extends from the base 2 near the center thereof as depicted in FIG. 2. The support arm 3 supports the reel 4 and guide means 5 preferably in alignment with one another. Such alignment can be achieved by securing the reel 4 and guide means 5 on a straight portion 7 of the support arm 3. The reel 4 can be attached to the support arm 3 by any suitable mounting bracket design. According to one embodiment of the present invention, a conventional spin-casting fishing reel was used as reel 4 and mounted (by screws) to support arm 3 using the attached mounting bracket 8 normally designed for connection thereof to a spin-casting fishing rod. Such mounting can be effected by a bonding material, e.g. epoxies, cement, etc. and/or mechanical fasteners such as screws, rivets, interlocking structures, etc.

The support arm 3 extends from the base 2 in an upright manner and can include an initial curved portion 9, as necessary, to ensure that the angle of a line drawn through the center of reel 4 and guide means 5 is in the range of 20° to 50° with respect to the base 2. This angle is based upon the trajectory characteristics of a driven golf ball and has been determined to provide for less overall resistance from the effects of tethering the golf ball, so that the resulting trajectory is similar to that of a non-tethered ball.

Figure 1B:
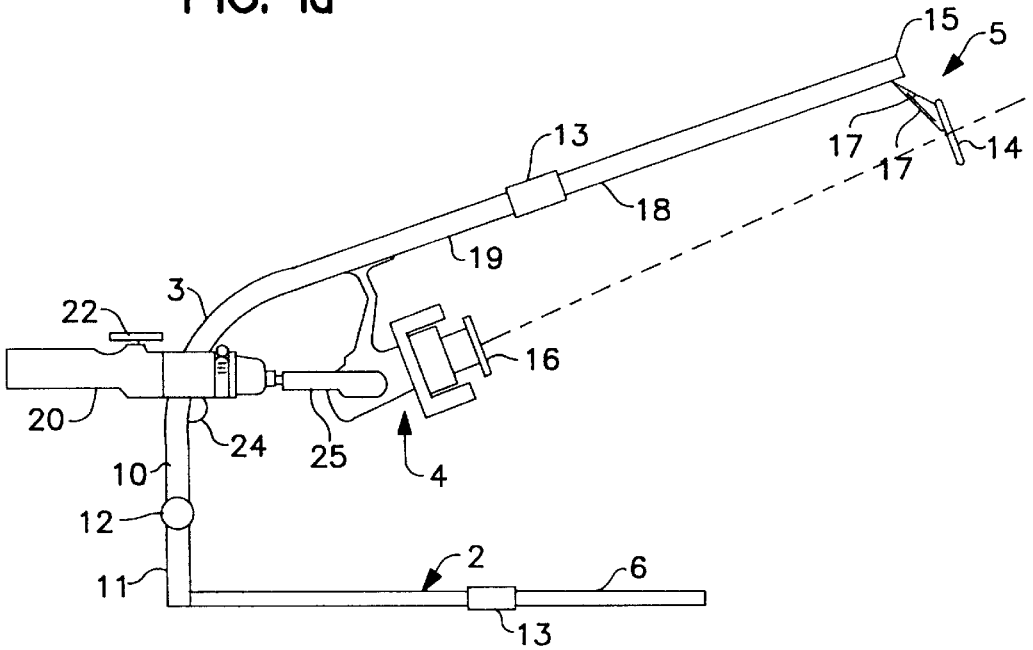
FIG. 1*b* is a side plan view of an alternative embodiment of the practice driving device of FIG. 1*a*.

In an alternative embodiment which is depicted in FIG. 1*b*, the support arm 3 can include two portions 10 and 11 which are coupled by a joint 12 which allows the angle between the two portions 10 and 11 to be adjustable. This embodiment will allow the angle of the straight portion 7 of the support arm 3 to be adjusted at an angle of between about 20° to about 50° with respect to base 2. The joint 12 can provide pre-set locking positions by such means as detentes or other engaging structures. Otherwise, the joint 12 could merely include a pivotal or swivel connection between portions 10 and 11 which can be clamped in position at any desired angle.

The support arm 3 is removably attachable to the base by any suitable means such as a post or sleeve on the base 2 which receives or couples with the support arm 3 which can be secured thereto by various structures including, a locking pin, detente, screw, bayonet mount, or other interconnecting structure. In a simpler embodiment, the support arm 3 and base 2 could merely be bolted together by a removable fastener. Having the support arm 3 removably connected to the base 2 allows the device to be disassembled for shipping and storage. In an alternative embodiment discussed below, both the support arm 3 and each of the legs 6 could comprise lockable telescopic elements which could be collapsed for shipping and storage.

The guide means 5 comprises an eyelet 14 which is coupled adjacent to the free end 15 of the support arm 3.

Ideally, the center of the eyelet 14 is aligned with the center of the reel 4 or at least the spool 16 of the reel 4. As depicted in FIG. 1*a* eyelet support arms 17 are used to couple the eyelet 14 adjacent to the free end of the support arm 3. These eyelet support arms 17 are dimensioned to position the center of the eyelet 14 in alignment with the center of reel 4 and can comprise the type of eyelet mounting braces which are conventionally used for mounting eyelets to fishing poles.

In FIG. 1*b* the straight portion 7 of the support arm 3 includes a coupler 13. This coupler 13 is provided at the intersection of telescoping segments 18 and 19 of the support arm 3 and can be used to lock telescoping segments 18 and 19 in a desired position. Thus, coupler 13 cooperates with telescoping segments 18 and 19 of support arm 3 so that the distance between the face of spool 16 and eyelet 14 can be adjusted in the range of about 12 inches to about 20 inches.

Reel 4 is driven by a mechanical means 20 which causes the spool 16 of reel 4 to rotate and thereby wind the tether 21 onto the spool 16. Although the mechanical means 20 can be a manual crank, the use of an electrical motor has been found to be particularly useful for purposes of the present invention. According to one embodiment of the present invention, the motor from a rechargeable cordless screwdriver was coupled to the drive mechanism of a conventional spin-casting fishing reel and used to wind the tether onto reel 4. In this embodiment, the cordless screwdriver was provided with a switch 22 which could be locked in the "on" position. The mechanical drive means 20 can be secured to the support arm 3 or base 2 by a suitable brace. FIG. 1*a* depicts a brace 24 which comprises a cross bar that is attached to support arm 3. As depicted in FIG. 1*a*, an off-set gear head 25 can be used to couple the mechanical drive mechanism 20 to reel 4.

FIG. 2 is a top plan view of the practice driving device of FIG. 1*a*. FIG. 2 depicts how the legs 6 of base 2 extend and provide a sturdy support for the device. The support arm 3 is depicted in FIG. 2 as being located in the center of legs 6. The reel 4 and guide means 5 are depicted as being axially aligned with the support arm 3. The eyelet 14 of the guide means 5 is perpendicular to the axis of the support arm 3 in FIG. 2. The mechanical drive means 20 for the reel 4 can extend from the reel 4 along any convenient direction. For example, the axis of the mechanical drive means 20 can be substantially parallel to the axis of the reel 4, perpendicular thereto, or be at any other desired angle. Due to the amount of clearance between the rear of reel 4 and the upright portion of the support arm 3, the axis of the mechanical drive means 20 cannot be parallel to the axis of the reel 4.

Figure 3:
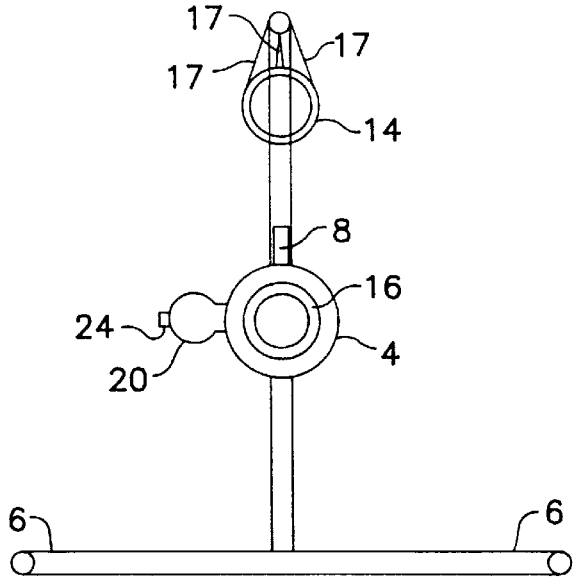
FIG. 3 is a front plan view of the practice driving device of FIG. 1*a*.

FIG. 3 is a front plan view of the practice driving device of FIG. 1*a*. The stability of the device is achieved by the support base formed by legs 6. This support base is sufficient to stabilize the center of mass of the attributed to the reel 4 and mechanical drive means 20. This center of mass is relatively low as compared to the distance between legs 6 of base 2. Reel 4 and eyelet 14 of the guide means 5 do not appear to be aligned in FIG. 3. Their depicted off-set is due to the fact that rather than being horizontally aligned, they are aligned with respect to the angle of support arm 3. This angle corresponds to the trajectory angle of a driven golf ball 26.

FIGS. 1–3 depict an embodiment of the present invention (referred herein as a "single ball" model) which includes a single reel 4 and guide means 5. The single ball model is designed for hitting one golf ball at a time and waiting for the tether 21 to be wound up on the reel 4 before hitting the golf ball 26 subsequent times. The present inventor has determined that there are several parameters of the single ball model which effect the flight characteristics of a golf ball 26. For example, a line drawn through the center of reel 4 and guide means 5 should be between 20° and 50°, and more preferably between 30° and 40°, and ideally about 37° with respect to the base 2. It has been determined that this angular range is suitable when the device is used on a substantially level surface. Because not all practice surfaces may be horizontal, the device can include a level, e.g., bubble level, in or on the base 2 for purposes of ensuring that the base 2 is level or horizontal. In addition, the support arm 3 can include a level appropriately calibrated to ensure that the straight portion 7 of the support arm 3 is within the desired angular alignment. The use of the angular adjustable support arm 3 of FIG. 1*b* can compensate for non-level or non-horizontal practice surfaces.

The distance between the face or spool 16 to the eyelet 14 should be between about 12 inches and about 20 inches, and more preferably between about 14 inches and about 18 inches, and ideally about 16 to 17 inches. The eyelet 14 should have a ring size of about 30 to 60, and more preferably about 40 to 60, with a ring size of about 50 (25/32 inches) being more preferred.

The tether 21 can be a line, cord, string, wire, etc. which has a suitable tensile strength to withstand the impact force applied to a golf ball 21 as it is struck by a golf club. Commercial fishing line having a two pound-test rating or greater has been found to be particularly useful for purposes of the present invention. In particular, fishing line which does not have a memory has been found to be preferred, since it pays out straight and stays level when retrieved. Monofilament, pure strand or woven fishing lines can be used.

Figure 4:
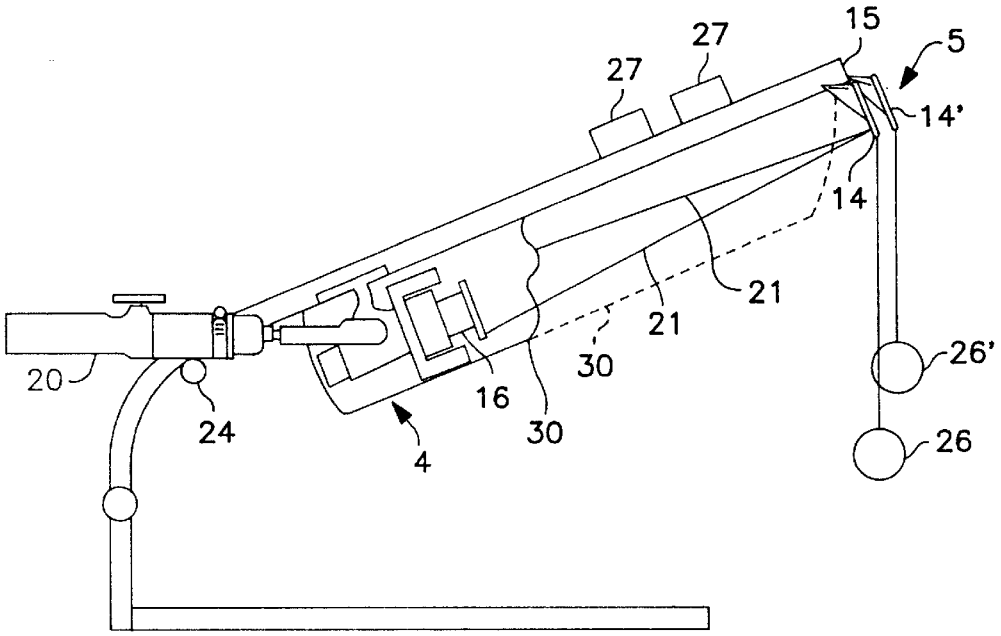
FIG. 4 is a side plan view of a practice driving device for golf balls according to another embodiment of the present invention.

FIG. 4 is a side plan view of a practice driving device for golf balls according to another embodiment of the present invention. The device of FIG. 4 (herein referred to as a "dual ball" model) includes two reels 4, two mechanical drive means 20, and two guide means 5, and is designed for simultaneously hitting and retrieving alternate golf balls. The dual ball model includes a base 2 having two legs 6. This base 2 is similar to the base 2 depicted in FIGS. 1–3 and discussed above. The dual ball model also includes a support arm 3 which is similar to the support arm 3 discussed above in reference to FIGS. 1–3. The dual ball model of FIG. 4 includes two reels 15 (one shown) which are attached to the support arm 3 in a radially spaced apart manner. The reels 15 can comprise conventional spin-casting fishing reels according to one embodiment and can be mounted or secured to the support arm 3 in the manner discussed above. The reels 15 are preferably spaced apart radially so there is clearance therebetween, and symmetrically so that their combined center of mass is aligned with the support arm 3.

The guide means 5 of the dual ball model of FIG. 4 includes two eyelets 14, 14', which are attached to the free end 15 of the support arm 3. The eyelets 14, 14' are radially spaced apart on the support arm 3 so that the center of each eyelet 14, 14' is aligned with the center of one of the reels 15, or the spools 16 of the reels 4. As depicted in FIG. 4, the eyelets 14, 14' can be staggered or off-set from one another along the axis of the support arm 3. In this regard, it is noted that the practice driving device of FIG. 4 is designed for a left-handed golfer. Such a golfer would face the device as it is depicted in FIG. 4, with the distant most eyelet 14' being positioned slightly beyond the closest or most near eyelet 14 along the axial direction of the free end 15 of the support arm 3. This manner of positioning the distant eyelet 14' helps prevent a tether 21' threaded therethrough from becoming caught on the other eyelet 14 when a golf ball 26' attached thereto is hit. A similar device designed for right-handed golfers would have the eyelets 14, 14' staggered in an opposite manner so that when facing the device from the opposite side, the distant most eyelet would be positioned slightly beyond the closest or most near eyelet along the axial direction of the free end 15 of the support arm 3. In an alternative embodiment the eyelets 14, 14' can be radially aligned with respect to support arm 3.

Each of the reels 4 includes a mechanical drive means 20 similar to the drive means 20 discussed above with reference to the FIGS. 1–3. The mechanical drive means 20 in the device of FIG. 4 can aligned so that their axial centers are aligned with the axial centers of reels 4. This coaxial alignment is possible in this embodiment because the upright portion of the support arm 3 does not obstruct such coaxial alignment as is the case of the embodiment depicted in FIGS. 1–3 above. The axis of the mechanical drive means 20 is not limited to being coaxial with the axis of the reels 4. In this regard, the mechanical drive means 20 and the reels 4 can have any convenient axial alignment. As discussed above, off-set gear heads 25 can be used to couple the mechanical drive mechanisms 20 to reels 4.

The mechanical drive means 20 can be supported by mounting them to the support arm 3 and/or the base 2. FIG. 4 depicts an embodiment in which the mechanical drive means 20 are mounted to the support arm 3 by means of a mounting arm 24 which extends outward on either side of the support arm 3. Mounting arm 24 can be integral with the support arm 3 or otherwise attached thereto by means of a suitable connector or welded thereto. In an alternative embodiment, the mounting arm 24 could be pivotally attached to the support arm 3 and locked into its operable position by a common, locking, brace similar to the type of braces which lock folding card table legs into position. A similar locking means could be provided between the base 2 and support arm 3 in order to allow the device to be folded for transportation and/or storage.

Figure 5:
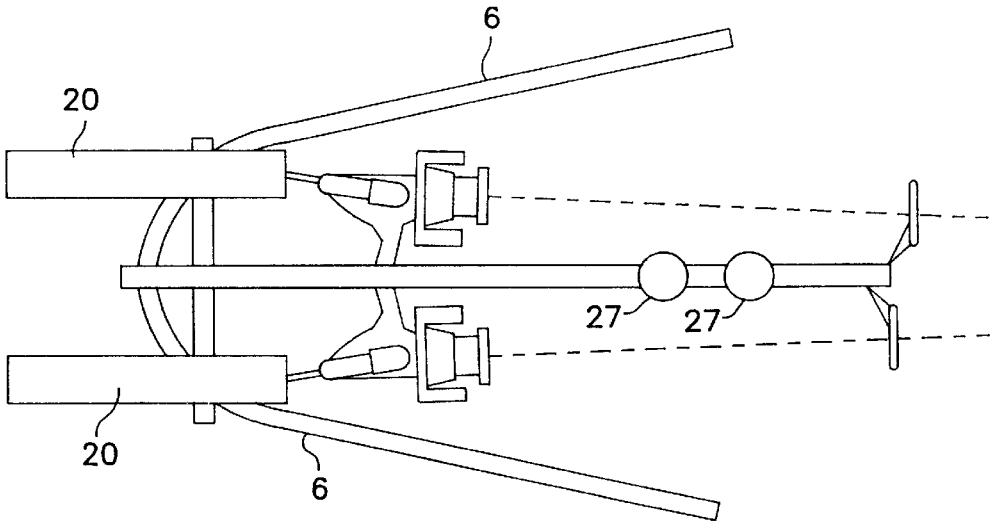
FIG. 5 is a top plan view of the practice driving device of FIG. 4.

FIG. 5 is a top plan view of the practice driving device of FIG. 4. FIG. 5 depicts how the legs 6 of base 2 extend and provide a sturdy support for the device. The support arm 3 is depicted in FIG. 5 as being located in the center of legs 6. The reels 4 and guide means 5 are depicted as being axially aligned with one another adjacent the support arm 3. The eyelets 14, 14' of the guide means 5 are perpendicular to the axis of the support arm 3 in FIG. 5. FIGS. 4 and 5 depict receptacles 27 which can be attached to support arm 3 or base 2 and used to store tethered balls therein.

Figure 6:
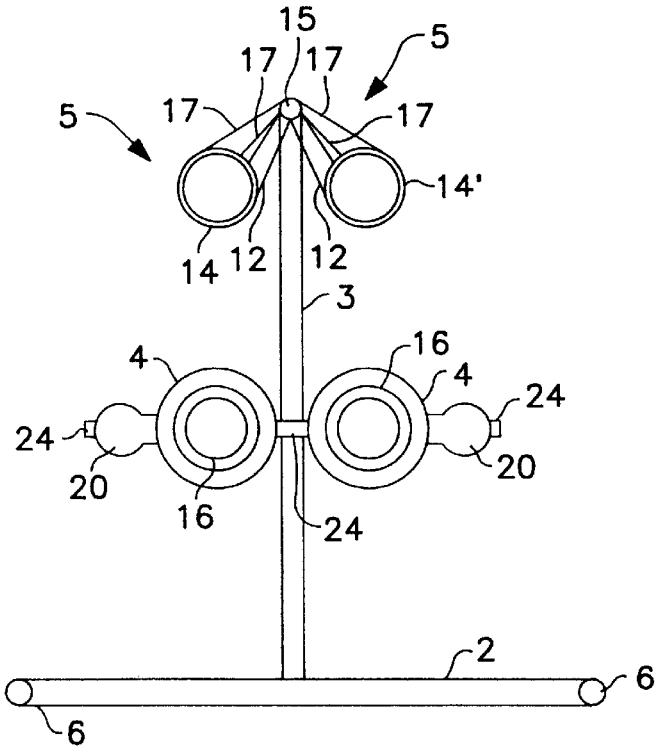
FIG. 6 is a front plan view of the practice driving device of FIG. 4.

FIG. 6 is a front plan view of the practice driving device of FIG. 4. The stability of the device is achieved by the support base formed by legs 6. This support base is sufficient to stabilize the center of mass of the attributed to the reels 4 and their respective mechanical drive means 20. This center of mass is relatively low as compared to the distance between legs 6 of base 2. Reels 4 and eyelets 14, 14' of the guide means 5 do not appear to be aligned in FIG. 3. Their depicted off-set is due to the fact that rather than being horizontally aligned, they are aligned with respect to the angle of support arm 3. This angle corresponds to the trajectory angle of a driven golf ball.

Figure 7:
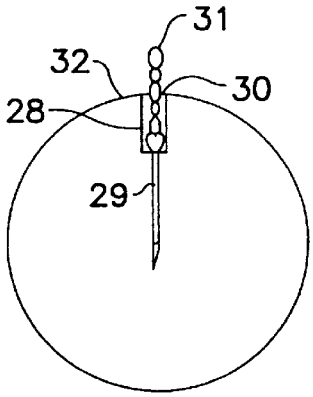
FIG. 7 is a cross sectional view of a tethered golf ball according to one embodiment of the present invention.

FIG. 7 is a cross sectional view of a tethered golf ball 26 according to one embodiment of the present invention. To provide a tethered golf ball, a standard golf ball 26 is provided with a small diameter bore 28 which is just wide enough to receive a barbed-shanked eyelet or a line to leader push-in eyelet 29. If a barbed-shanked eyelet is used it can be made by straightening out a small, e.g., number two fish hook. A barrel swivel 30 is attached to the barbed-shanked eyelet or line to leader push-in eyelet 29 and the eyelet 29 is inserted into the bore 28 so that the free eyelet 31 of the barrel swivel 30 extends beyond the surface 32 of the golf ball 26 as depicted in FIG. 7. Ideally, a portion of the swivel body 30 extends from bore 28 as depicted. This ensures that the golf ball 26 is allowed to freely rotate with respect to the tether, particularly during retrieval.

In order to maintain the balance of the golf ball, the weight of the material removed from the bore 28 should be substantially equal to the combined weight of the barbed-shanked eyelet or line to leader push-in eyelet 29 and the barrel swivel 30.

Figure 8:
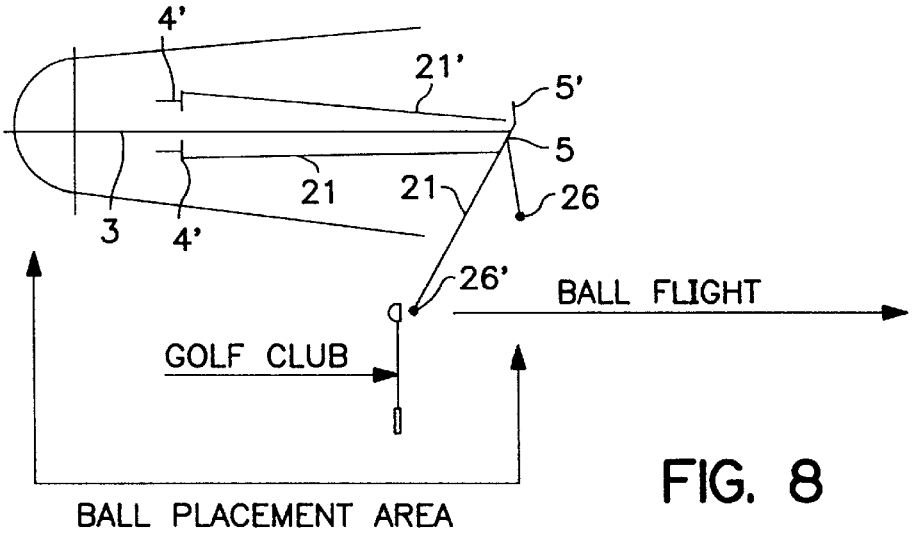
FIG. 8 is a diagram which depicts ball placement when using the device of the present invention.

FIG. 8 is a diagram which depicts ball placement when using a dual ball model device of the present invention. To use the device, it is placed so that the support arm 3 is pointing in the direction that the balls are to be hit. The golf ball 26' which is tethered to the distant most reel 4' and through the distant most guide means 14' (hereafter referred to as the "outer ball") is hit first. In order to hit the outer ball 26', the user opens the bale on the distant most reel 4' and lifts the outer ball 26' over the eyelet 14 of the inner ball 26, as indicated in FIG. 8. The balls can be placed anywhere in the ball placement area as show in FIG. 8. The ball placement area extends along the side of the device and is preferably coextensive in length with the device.

The balls can be struck at any point except where the tether 21 is attached. After flight, the mechanical drive means 20' is actuated by pushing an "on/off" switch associated therewith. Activation of the mechanical drive means 20' begins retrieval of the outer or first ball 26'. As the first ball 26' is being retrieved, the bale of the inner reel 4 is opened, the inner ball 26 is placed in the ball placement area, and hit. After the flight of the inner ball 26, the mechanical drive means 20 is actuated by pushing an "on/off" switch associated therewith. Activation of the mechanical drive means 20 begins retrieval of the second or inner ball 26. When the outer ball 26' has been retrieved, the bale of reel 4' is opened and the above steps are repeated, this allows more shots to be struck per session by greatly reducing the waiting time (retrieval time) between shots.

According to one embodiment, the mechanical drive means 20 are each provided with "on/off" switches. Such switches can be operated by hand. Alternatively, levers can be attached to the "on/off" switches so that they can be activated by a user's foot or by pressing the levers with an end of a golf club. In a further embodiment, the "on/off" switches could be replaced with wired or non-wired remote switches.

It is noted that the mechanical drive means 20 can be operated at any point after a golf ball is hit. Thus, it is possible to stop the flight of a badly hit ball by merely actuating the mechanical drive means at the beginning of the ball's flight. This ability to arrest balls in flight can be used to shorten the time between shots. The use of conventional spin-casting fishing reels such as those of the Garcia "Cardinal" series, incorporates a drag adjustment setting. This drag adjustment setting can be adjusted to increase the drag when more pulling force is required to retrieve a ball. For example, more pulling force may be required when it is necessary to retrieve a ball that has been hit into brush, heavy weeds, etc.

A line guard 30 is provided between the reels 4 on the dual ball model depicted in FIGS. 4–6 (see FIG. 4).

This line guard 30 comprises a flat member which prevents the tether 21 being pulled off one reel 4 from becoming caught by the spool or bail of the other reel 4.

Ball retrieval can be stopped manually once the user observes a retrieved ball entering the proximity of the device. Ball retrieval can be stopped in an automated manner by providing proximity sensors near the front of the device, e.g. mounted on the legs of the base, or independently positioned in front of the device. The proximity sensors could deactivate the "on" switch which normally activates the mechanical drive means during ball retrieval. Examples of proximity sensors include motion sensors, infrared sensors, etc. Such proximity sensors and their switching circuitry can be powered by a power cell or battery pack mounted on a convenient position on or near the device.

The tether must have a sufficient strength to retrieve a hit ball from across a given terrain which may include a short grassy field, a tall grassy field, areas of brush, a body of water, etc. A thicker tether, e.g. heavier weight fishing line may be required in some instances. A lighter tether, e.g. low weight fishing line, will reduce line-pull on the ball during its flight. No memory line is preferred since it is not subject to coiling. Coiling of line which has a shape memory causes the line to recoil after it is payed out. In addition, coiled line has an increased wind resistance and tends to twist and tangle during retrieval. As examples of line types, the present inventor has determined that a beginning golfer hitting into brush, weeds, etc. should use a line weight of no more six pounds test strength. An intermediate golfer hitting into a body of water, medium grasses, etc. should use a line weight of no more than four pound test strength. A good golfer hitting into short grass, ice, or other open areas should use a line weight of two pound test strength or less.

The frame of the device, including the base, support arm and mount arm can be made of metal, graphite, fiberglass or any similar sturdy material. These frame members can be made from tubular components, or solid components.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A golf practice apparatus which comprises:

a base;

an elongated support arm coupled to the base and having a free end;

a tether guide means including an eyelet coupled to the elongated support arm adjacent the free end; and a reel attached to the elongated support arm near the base and remote from the free end the reel including a spool, the spool having a central axis which is aligned with a center of the eyelet of the guide means.

2. The golf practice apparatus according to claim 1, wherein the elongated support arm is angled with respect to the base so that the spool and the eyelet of the guide means are aligned at an angle of 20° to 50° with respect to the base.

3. The golf practice apparatus according to claim 2, wherein the elongated support arm includes means for selectively changing the angle at which the spool and guide means are aligned with respect to the base.

4. The golf practice apparatus according to claim 1, wherein the base includes two leg members.

5. The golf practice apparatus according to claim 1, further including means to a drive means coupled to the reel.

6. The golf practice apparatus according to claim 5, wherein the drive means is supported by the elongated support arm.

7. The golf practice apparatus according to claim 5, wherein the drive means comprises an electric motor.

8. The golf practice apparatus according to claim 1, further including another reel attached to the elongated support arm and including a spool.

9. The golf practice apparatus according to claim 8 wherein the guide means includes another tether eyelet having a center which is aligned with a center of the another reel.

10. The golf practice apparatus according to claim 9, wherein the elongated support arm is angled with respect to the base so that the spool and the eyelet of the guide means are aligned at an angle of 20° to 50° with respect to the base.

11. The golf practice apparatus according to claim 10, wherein the elongated support arm includes means for selectively changing the angle at which the spool and guide means are aligned with respect to the base.

12. The golf practice apparatus according to claim 11, wherein the eyelets are off-set from one another along an axis of the elongated support arm.

13. The golf practice apparatus according to claim 8, further comprising another drive means coupled to the another reel.

14. The golf practice apparatus according to claim 8, further comprising a tether guard positioned between the reels.

15. The golf practice apparatus according to claim 1, wherein the length of the elongated support arm is adjustable.

* * * * *